US007393024B2

(12) United States Patent
Bella

(10) Patent No.: US 7,393,024 B2
(45) Date of Patent: Jul. 1, 2008

(54) PUSH LATCH

(75) Inventor: Joseph J. Bella, Plainfield, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/540,782

(22) Filed: Sep. 29, 2006

(65) Prior Publication Data

US 2007/0120376 A1 May 31, 2007

Related U.S. Application Data

(60) Provisional application No. 60/736,494, filed on Nov. 14, 2005.

(51) Int. Cl.
*E05C 1/12* (2006.01)

(52) U.S. Cl. ..... 292/170; 292/DIG. 37

(58) Field of Classification Search ..... 292/DIG. 37, 292/DIG. 4, 169, 170
See application file for complete search history.

(56) References Cited

U.S. PATENT DOCUMENTS

| | | | | |
|---|---|---|---|---|
| 1,965,939 | A | 7/1934 | Jacobi | |
| 2,036,154 | A * | 3/1936 | Littledale | 292/170 |
| 2,573,061 | A | 10/1951 | Raymond | |
| 2,726,889 | A * | 12/1955 | Lawson | 292/170 |
| 3,919,866 | A * | 11/1975 | Lipschutz | 70/81 |
| 4,875,299 | A * | 10/1989 | Mabboux et al. | 36/118.6 |
| 5,484,178 | A * | 1/1996 | Sandhu et al. | 292/173 |
| 7,188,871 | B2 * | 3/2007 | Nemoto et al. | 292/170 |
| 7,234,735 | B2 * | 6/2007 | Harada | 292/170 |
| 2004/0256859 | A1 | 12/2004 | Yamada | |
| 2005/0156433 | A1 | 7/2005 | Nemoto et al. | |

FOREIGN PATENT DOCUMENTS

| | | |
|---|---|---|
| GB | 2410058 | 7/2005 |

* cited by examiner

*Primary Examiner*—Gary Estremsky
(74) *Attorney, Agent, or Firm*—Mark W. Croll; Paul F. Donovan

(57) ABSTRACT

A push button latch includes a housing, an actuator movable along a path substantially axial of the housing and a lock movable along a path transverse to the axial path. A spring biases the lock to a latching position, and structures in the lock and housing inhibit unintended opening of the latch.

13 Claims, 4 Drawing Sheets

PUSH LATCH

CROSS-REFERENCE TO RELATED APPLICATIONS

The present regular United States Patent Application claims the benefits of U.S. Provisional Application Ser. No. 60/736,494 filed on Nov. 14, 2005.

FIELD OF THE INVENTION

The present invention relates generally to latches and, more particularly, the invention pertains to push style latches commonly used to secure compartment doors, bins, glove boxes, and the like.

BACKGROUND OF THE INVENTION

Latches are used extensively on various types of bins and enclosures. Latches are used extensively in the automotive industry, with each individual automobile potentially having several latched areas, such as glove boxes, consoles, storage bins and the like. It is known to employ latches that include a pawl or arm-like member that engages a mating structure such as the bin door when the door is in a closed position. It is known further to use push-button releases on a latch to retract the pawl or arm to allow the device to open. Upon release of the latched component, opening may be caused by gravity, manual manipulation, mechanical driving force from springs or pneumatic cylinders or the like. Push button latches have achieved acceptance for their convenience, including ease of operation.

A problem with push-style latches of this type is that the pawl or arm may be caused to retract at an undesirable time. For example, in automobile and other applications excessive vibration, such as when driving over rough or irregular roads; sudden jarring forces, such as when driving over a bump or when encountering a pothole; or quick motions in one direction or another can impart forces on the latch or pawl that can cause the pawl to retract, thereby allowing the latched item to be released. Accordingly, a push-style latch that remains stable during such conditions is desirable.

It is desirable to provide push latches with simplified structures and few individual parts. Some known prior art latches are complex with relatively many individual parts. Accordingly, assembly can be difficult and time-consuming as the relatively small parts need to be assembled correctly. Further, the complex structures can be difficult to maintain.

SUMMARY OF THE INVENTION

The present invention provides a pushbutton latch having a minimal number of parts and stabilizers to increase stability of the latch in the closed or engaged position.

In one aspect thereof, the present invention provides a latch with a monolithic housing; a monolithic lock having a base disposed in the housing and a pawl extending outwardly from the housing. The lock is translatable in a first direction relative to the housing for moving the pawl into and out of the housing and substantially immovable in a second direction relative to the housing. A monolithic actuator is disposed at least partly in the housing and is connected to the lock in the housing. The actuator is substantially immovable in the first direction and translatable in the second direction relative to the housing. The lock and the actuator are interconnected in the housing one with the other for movement of one of the lock and the actuator upon the movement of the other of the lock and the actuator.

In another aspect thereof, the present invention provides a push button latch with a housing having walls defining four sides and an open end, one wall having a channel therein. An actuator has a push button and spaced first and second arms. The arms extend into the housing from the open end along opposed walls adjacent to the one wall. The arms each have an angular slot therein. A lock disposed between the arms has a base, a pawl extending outwardly from the base through the channel, and first and second pins disposed in the slots of the arms. A spring biases the pawl outward relative to the channel.

In a still further aspect thereof, the present invention provides a push actuated latch with a housing having walls defining four sides and an open end, one wall defining a channel extending from and open at the open end. An actuator has a push button and spaced first and second arms extending into the housing through the open end. The arms are disposed along opposed walls each adjacent the wall defining the channel. A lock has a base, a pawl extending outwardly from the base through the channel in the housing, and first and second sides from the base disposed between the first and second arms of the actuator. A spring biases the pawl outwardly relative to the housing. The arms and the sides defining interrelating structures for controlling movement of one with respect to the other, the pawl and the arms being substantially axially translatable in first and second directions substantially transverse to one another.

An advantage of the present invention is providing a push latch that is simple in operation with few moving parts.

Another advantage of the present invention is providing a push latch having stabilizers to improve stability of the latch when closed.

Still another advantage of the present invention is providing a push latch having components that are easy to manufacture by injection molding or the like.

Other features and advantages of the invention will become apparent to those skilled in the art upon review of the following detailed description, claims and drawings in which like numerals are used to designate like features.

Figure 1:
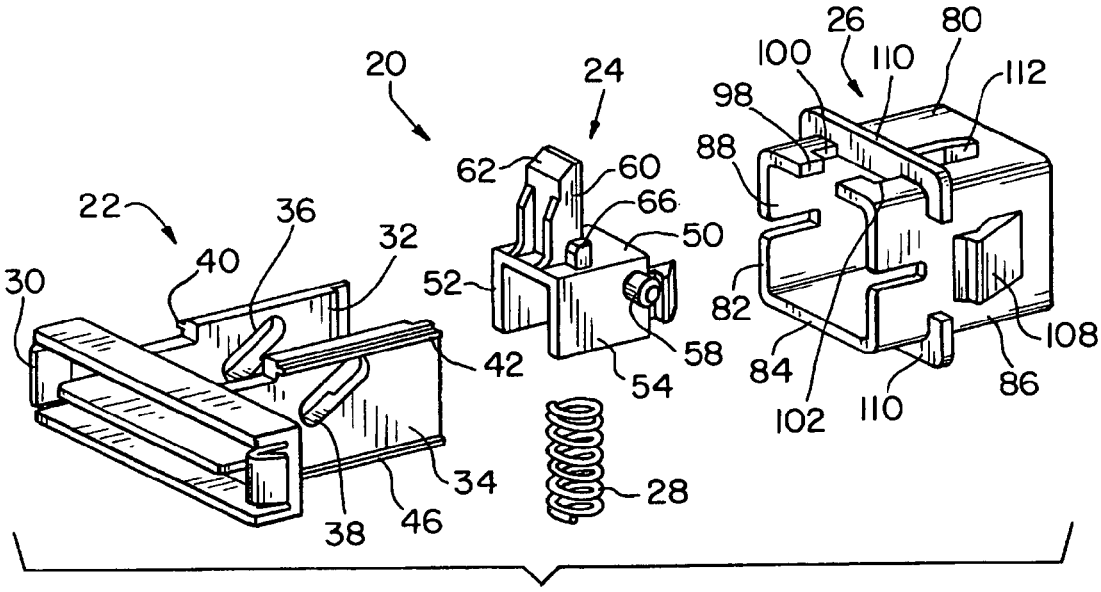
FIG. 1 is an exploded view of a push latch of the present invention.
Figure 2:
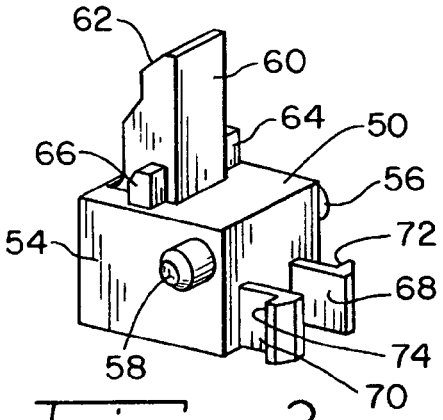
FIG. 2 a perspective view of the lock component of the latch shown in FIG. 1, illustrating a side opposite the side shown in FIG. 1.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Referring now more specifically to the drawings and to FIG. 1 in particular, numeral 20 designates a push-button latch in accordance with the present invention. Latch 20 includes an actuator 22, a lock 24, a housing 26 and a spring 28.

Actuator 22 includes a push button 30 which can be configured to hold a decorative panel or the like, or can be complete on its own. Push button 30 is the readily accessible portion of latch 20 accessed by a user to release latch 20. Push button 30 in the exemplary embodiment is a rectangular elongated body; however, those skilled in the art should readily recognize that push button 30 can be of different sizes, shapes and the like, including for example, round, square, rectangular or the like. Actuator 22 further includes first and second arms 32 and 34, respectively, which form a monolithic structure with push button 30. First and second arms 32, 34 are disposed in spaced relation one to the other and define therein first and second slots 36 and 38, respectively. Slots 36 and 38 are oriented angularly in arms 32 and 34, and in the exemplary embodiment slots 36 and 38 angle outwardly toward edges of arms 32 and 34 from positions nearer to pushbutton 32 positions more distant from pushbutton 30. On opposed edges thereof, arms 32 and 34 define first rails 40 and 42, respectively, and second rails 44 and 46, respectively, each configured to slide within housing 26.

Actuator 22, including pushbutton 30; first and second arms 32, 34; first rails 40, 42 and second rails 44, 46 can be manufactured as a single, monolithic body of plastic by injection molding or the like. However, other materials and manufacturing techniques also can be used, and actuator 22 can be made of multiple parts.

Lock 24 includes a base 50 having first and second spaced sides 52, 54 extending therefrom. First and second sides 52, 54 have first and second pins 56, 58, respectively, projecting outwardly therefrom. Accordingly, pins 56 and 58 are disposed in oppositely oriented directions outwardly from lock 24 on opposite sides thereof. First and second pins 56, 58 are configured to be received in first and second slots 36 and 38, respectively.

A pawl 60 projects from base 50 in a direction substantially normal to the direction of projection of pins 56, 58 from lock 24. Pawl 60 extends through and outwardly of housing 26 and is moveable in directions to engage mating structure of the device in which latch 20 is installed, both to latch and unlatch the device. In the exemplary embodiment illustrated, pawl 60 and lock 24 are configured to move in a substantially linear direction with respect to an axis defined by pawl 60, for both latching and unlatching, as will be described in further detail hereinafter. Pawl 60 includes a distal end 62 that is angled to allow pawl 60 to be forcibly retracted during closing. First and second stabilizers 64, 66 are disposed adjacent pawl 60 and project co-directionally with pawl 60. Stabilizers 64 and 66 are generally shorter than pawl 60. Deflectable arms 68, 70 at inward edges of the installed positions of first and second sides 52, 54, respectively, are provided to secure lock 24 in housing 26. Deflectable arms 68, 70 include outwardly disposed lips 72 and 74, respectively, for snap-fit engagement of lock 24 and housing 26. A post 76 is provided beneath base 50 and between sides 52, 54. Post 76 receives spring 28 thereon.

Lock 24 as described above, including base 50; sides 52, 54; pins 56, 58; pawl 60; stabilizers 64, 66 lock arms 68, 70 with lips 72, 74 and post 76 can be manufactured as a single monolithic body from suitable plastic material by injection molding or the like. However, other suitable materials and other manufacturing means can be used, including manufacturing multiple parts.

Housing 26 is a box-like structure with four adjacent walls 80, 82, 84, 86 defining sides of an enclosure in which lock 24 and arms 32, 34 of actuator 22 are operatively arranged. Accordingly, housing 26 defines at least one open end 88 for receiving arms 32, 34 of actuator 22 with lock 24 disposed generally between arms 32, 34. In the assembled arrangement of latch 20, first and second arms 32, 34 extend generally along opposed walls 82, 86, respectively. First and second rails 40, 44 of first arm 32 are disposed along opposed walls 80 and 84, respectively, and wall 86 that is adjacent to each wall 80 and wall 84. First and second rails 42, 46 of second arm 34 are disposed along opposed walls 80 and 84, respectively, and wall 82 that is adjacent to each wall 80 and wall 84. Intersection areas 90, 92, 94 and 96 between adjacent walls 80, 82; 82, 84; 84, 86 and 86, 82 can be chamfered or rounded for smooth sliding engagement with rails 40, 42, 44 and 46.

Wall 80 defines an entrance channel 98 that is open at open end 88 for receiving pawl 60 during assembly. Confined transverse channels 100, 102 extend from opposite sides of the inner end of entrance channel 98. Confined transverse channels 100, 102 receive stabilizers 64, 66 when pawl 60 is extended.

Figure 3:
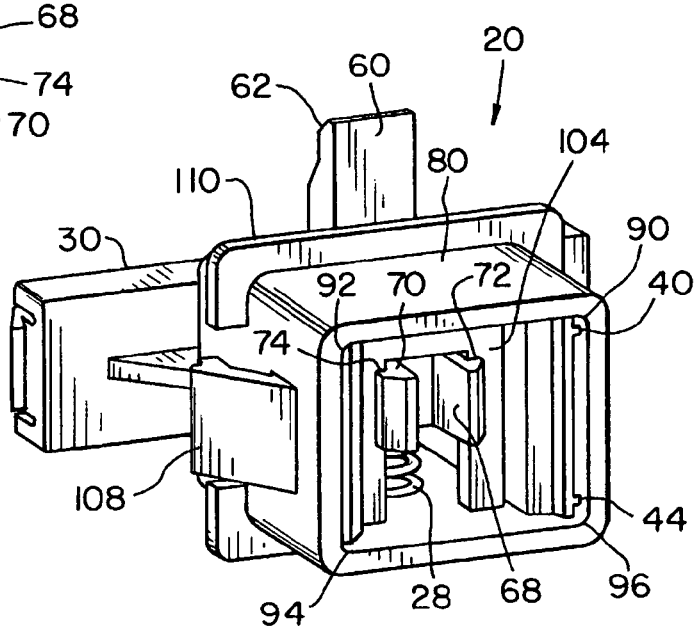
FIG. 3 is a perspective view of an assembled push latch in accordance with the present invention.
Figure 4:
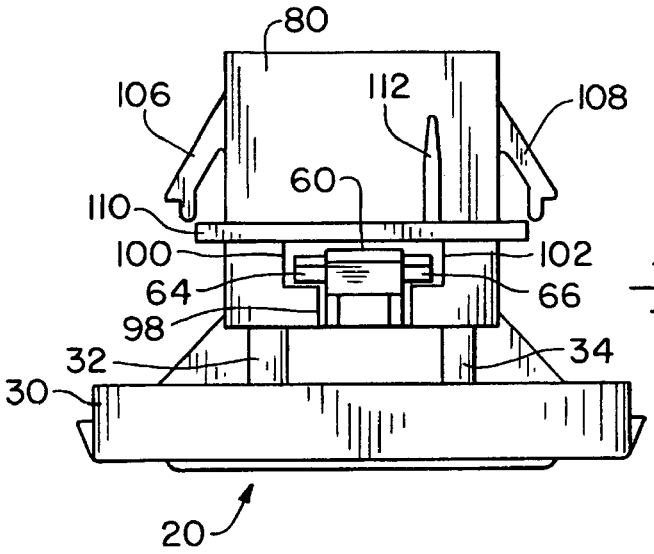
FIG. 4 is a plan view of the latch illustrating the side from which the pawl extends.
Figure 5:
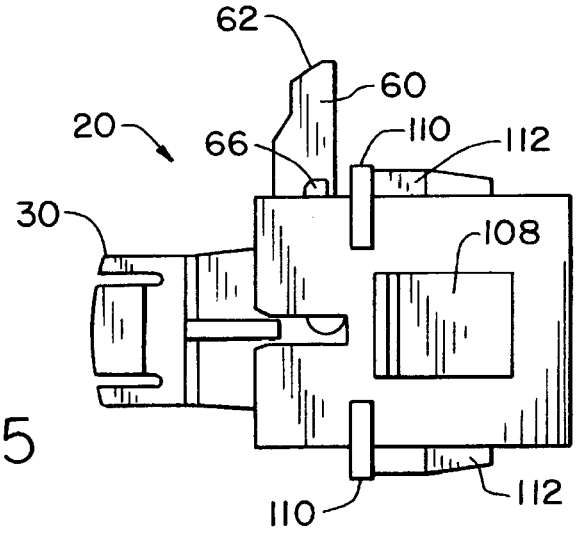
FIG. 5 is a plan view from a side adjacent the side illustrated in FIG. 3.

A partition 104 within housing 26 engages deflectable lock arms 68, 70 (FIG. 3) during assembly, with arms 68, 70 disposed along inside edges of partition 104 and lips 72, 74 overlie a surface of partition 104. Engagement of lock arms 68, 70 with partition 104 inhibits axial movement of lock 26 inwardly or outwardly relative to open end 88 of housing 26. However, lock arms 68, 70 can slide along partition 104, generally in the opposed directions between walls 80 and 84.

Exterior surface formations on housing 26, such as snap connection features 106, 108, one or more flange 110 and various locators 112 (FIG. 3) or the like are provided for positioning and securing latch assembly 20 in the device in which it is to be used.

Housing 26 as described above, including the walls 80, 82, 84, 86; partition 104; snap connection features 106, 108; flange 110 and locator 112 can be manufactured as a single monolithic body of plastic by injection molding. Housing 26 also can be made of other suitable materials by other suitable manufacturing means and can be manufactured of multiple parts.

In the assembled configuration of latch assembly 20, lock 24 is positioned between arms 32, 34 with first and second pins 56, 58 located in first and second slots 36, 38 respectively. Spring 28 is placed on post 76, and the subassembly of actuator 22, lock 24 and spring 28 is slid into housing 26, with pawl 60 traversing entrance channel 98 to a position substantially adjacent flange 110. During assembly, pawl 60 is retracted slightly so that stabilizers 64, 66 pass beneath wall 80. Spring 28 on post 76 is confined between base 50 of lock 24 and wall 84 of housing 26.

Figure 8:
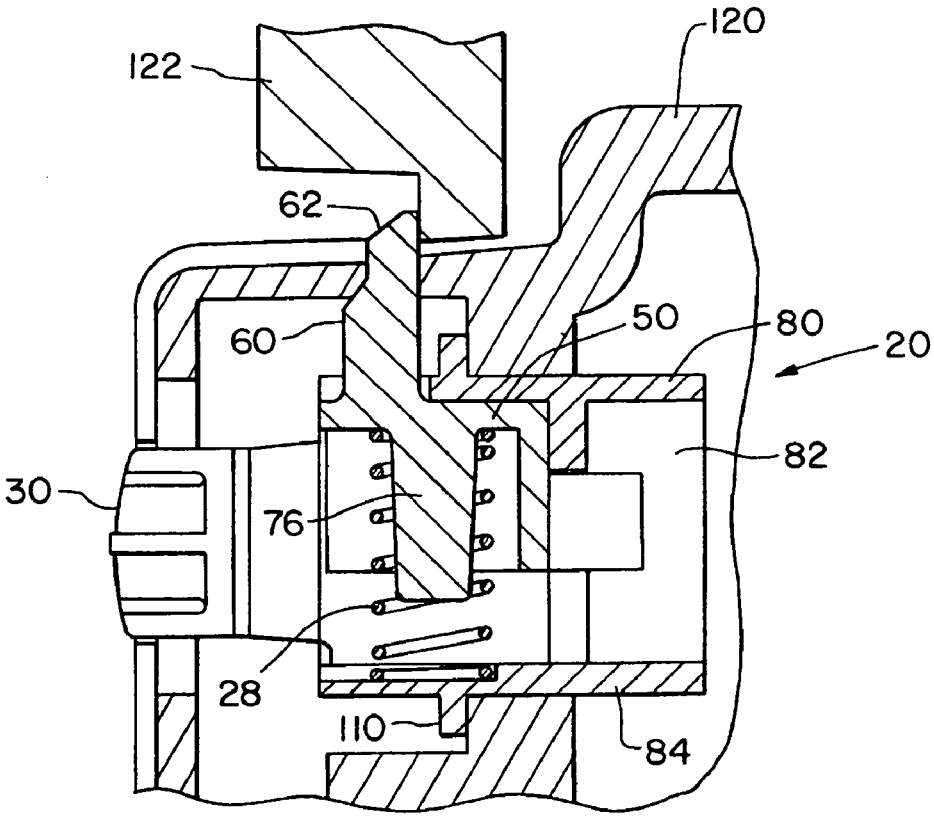
FIG. 8 is a cross-sectional view of the latch installed in an assembly.

FIG. 8 illustrates in cross-section the installed position of a latch 20 in a first component 120 associated with a second component 122. It should be understood that latch 20 can be installed with a primarily stationary first component 120 for engaging and disengaging a movable second component 122; or, alternatively, latch 20 can be installed in a movable components for engaging and disengaging a primarily stationary component. Spring 28 urges pawl 60 outwardly. Pawl 60 is disengaged from second component 122 by depressing pushbutton 30.

Figure 6:
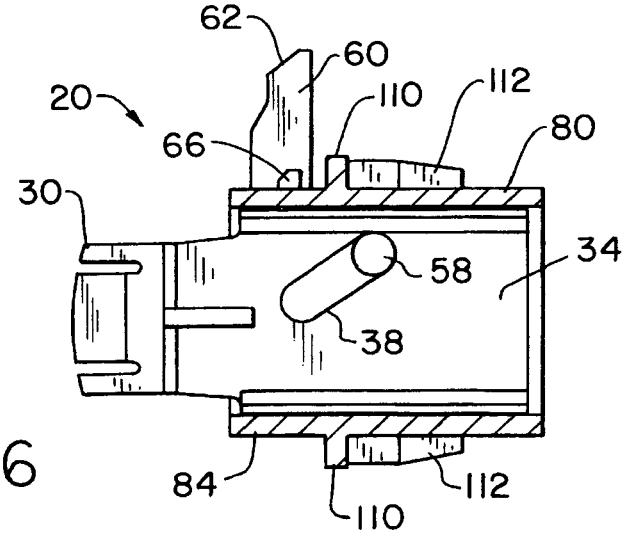
FIG. 6 is a cross-sectional view of the latch illustrated in FIG. 5, revealing the inner assembly with the latch in an extended condition.
Figure 7:
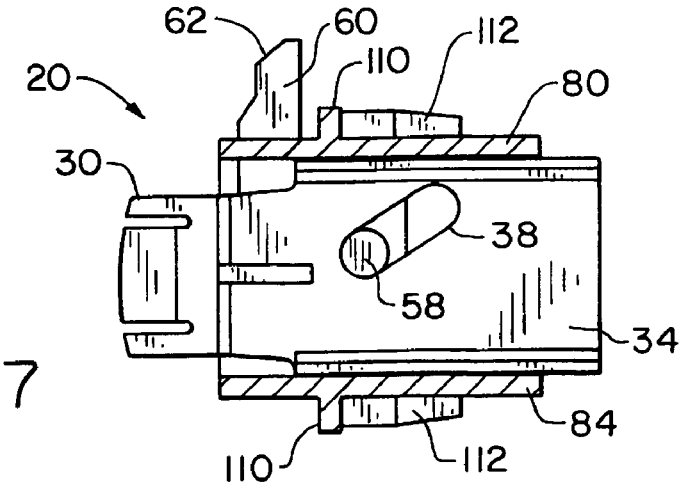
FIG. 7 is a cross-sectional view similar to that of FIG. 6, but illustrating the latch in a depressed condition with the pawl withdrawn for releasing a component held thereby.
Figure 9:
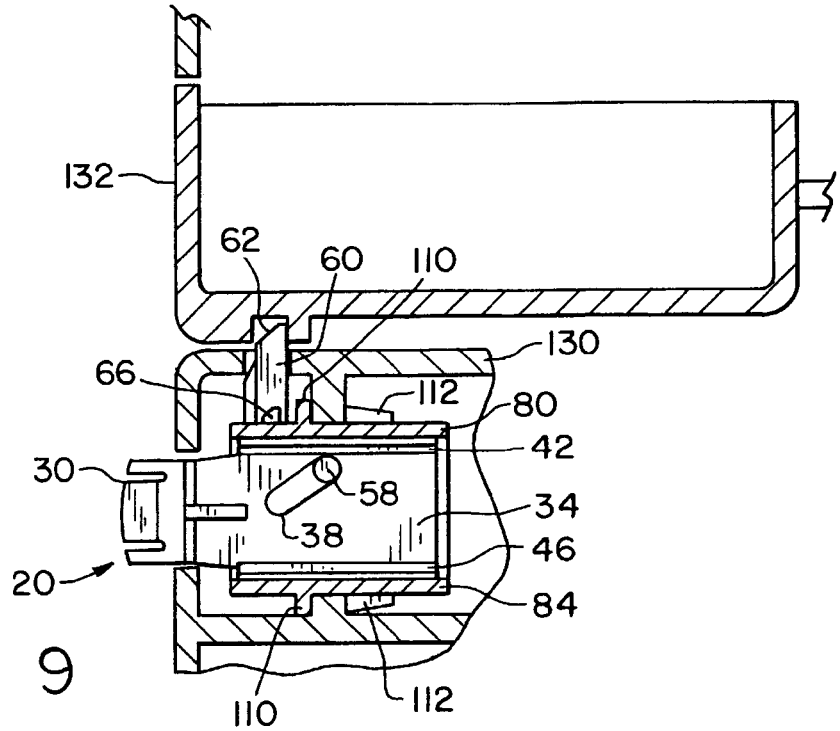
FIG. 9 is a cross-sectional view of the latch installed in another assembly, with the device secured by the latch illustrated in a closed or latched condition.
Figure 10:
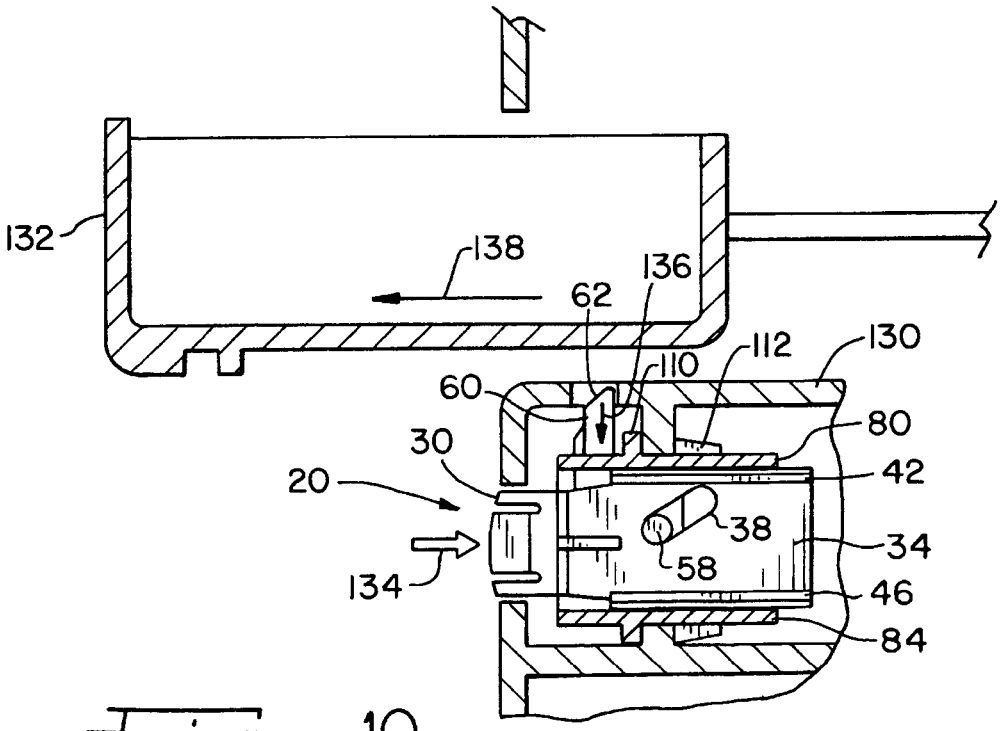
FIG. 10 is a cross-sectional view similar to that shown in FIG. 9, but illustrating the device in a released condition.

FIGS. 9 and 10 illustrate the latched and the unlatched conditions, respectively, of a pushbutton latch 20 installed in a frame or body 130 for securing a compartment 132 that may be spring actuated, manually manipulated or the like. While the cross-sectional view of FIG. 8 illustrates a substantially a center line cross-section of latch 20, FIGS. 9 and 10 illustrate cross-sectional views primarily removing wall 82 and exposing second side 54, including slot 38 and pin 58 disposed therein. FIGS. 6 and 7 are similar to FIGS. 9 and 10, respectively, but without illustrating the apparatus in which latch 20 is installed.

In a latched condition, with pawl 60 urged outwardly by spring 28, pins 56, 58 are held within slots 36, 38 toward ends nearest first rails 40, 42. Since an axial position of lock 24 with respect to open end 88 of housing 26 is substantially fixed, the outward position of pawl 60, held by spring 28, holds actuator 22 outward relative to open end 88 of housing 26 from the interconnection of actuator 22 and lock 24 via pins 56, 58 in slots 36, 38.

When push button 30 is pressed in the direction indicated by arrow 134, actuator 22 including arms 32, 34 moves inwardly relative to open end 88 of housing 26. The axially inward movements of slots 36, 38 cause retraction of pawl 60 in the direction of arrow 136, as pins 56, 58 follow along the angular paths defined by slots 36, 38. Pawl 60 thereby releases compartment 132 for outward movement (arrow 138). Spring 28 is compressed as locking arms 68, 70 slide along partition 104 and base 50 moves closer to wall 84, thereby minimizing the space within which spring 28 is located.

When push button 30 is released, spring 28 returns lock 24 to its outward position. Locking arms 68, 70 slide along partition 104 toward wall 80. As pins 56, 58 are moved, engagement with actuator 22 via slots 36, 38 moves push button 30 and actuator 22 outwardly relative to open end 88.

Angled distal end 62 on pawl 60 facilitates inward movement of pawl 60 when compartment 132 is pushed against distal end 62 as compartment 132 is pushed shut.

During both opening and closing, lock 24 moves substantially linearly and pawl 60 moves substantially axially in and out relative to housing 26. Accordingly, pawl 60 remains aligned with entrance channel 98 even after assembly. A potential rotational axis of lock 24 is defined by pins 56, 58 in slots 36, 38. In the outward position of pawl 60, stabilizers 64, 66 are disposed in confined channels 100, 102, that extended transverse to entrance channel 98. Stabilizers 64, 66 within channels 100, 102 thereby preventing rotation of lock 24 about the rotational axis defined by pins 56, 58 and thereby inhibit unintentional opening through unintended rotation of pawl 60 outwardly in entrance channel 98.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A latch comprising:

a monolithic housing;

a monolithic lock having a base disposed in said housing and a pawl extending outwardly from said housing, said pawl extending from said housing so as to be non-rotatable with respect to said housing, said lock being translatable in a first direction relative to said housing for moving said pawl into and out of said housing and substantially immovable in a second direction relative to said housing, said lock including a post;

a spring on said post biasing said lock to an outward position of said pawl relative to said housing;

a monolithic actuator at least partly disposed in said housing and connected to said lock in said housing, said actuator being substantially immovable in said first direction and translatable in said second direction relative to said housing;

said lock and said actuator being interconnected in said housing one with the other for movement of one of said lock and said actuator upon the movement of the other of said lock and said actuator;

said actuator having first and second arms in spaced relation and said lock base being disposed between said arms; and each said arm having an angular slot therein, and said lock including laterally extending first and second pins, one said pin disposed in each said slot.

2. The latch of claim 1, including a spring biasing said lock to an outward position of said pawl relative to said housing.

3. The latch of claim 1, including a stabilizer on said lock extending through a wall of said housing and restraining rotation of said lock about an axis defined by said first and second pins.

4. The latch of claim 1, said housing comprising a box having an open end, and said second direction being substantially axially in said housing through said open end.

5. The latch of claim 1, said first direction being substantially an axial direction of said pawl.

6. A push button latch comprising:

a housing having walls defining four sides and an open end, one said wall having a channel therein;

an actuator having a push button and spaced first and second arms, said arms extending into said housing from said open end along opposed walls adjacent to said one wall, said arms each having an angular slot therein;

a lock disposed between said arms and having a base, a pawl extending outwardly from said base through said channel, and first and second pins disposed in said slots of said arms; and a spring biasing said pawl outward relative to said channel;

wherein said housing has a partition, and said lock has lock arms engaging said partition and restricting axial movement of said lock relative to said housing open end.

7. The push button latch of claim 6, said base having a post and said spring being disposed on said post.

8. The push button latch of claim 6, said lock including a stabilizer extending through one said wall when said pawl is in an outward position.

9. The push button latch of claim 8, said base having a post and said spring being disposed on said post.

10. The push button latch of claim 8, said channel being an entrance channel open at said open end, and said one wall having a second channel transverse to said entrance channel, said stabilizer being disposed in said transverse channel.

11. The push button latch of claim 6, said pawl having an angular distal tip.

12. A push actuated latch comprising:

a housing having walls defining four sides and an open end, one said wall defining a channel therein extending from and open at said open end;

an actuator having a push button and spaced first and second arms extending into said housing through said open end, said arms being disposed along opposed ones of said walls each adjacent said wall defining said channel;

a lock having a base, a pawl extending outwardly from said base through said channel in said housing, and first and second sides from said base disposed between said first and second arms of said actuator;

a spring biasing said pawl outwardly relative to said housing; and said arms and said sides defining interrelating structures for controlling movement of one with respect to the other, said pawl and said arms being substantially axially translatable in first and second directions substantially transverse to one another, said interrelating structure including at least one slot and a pin disposed in and movable within said slot, and said arms defining at least one said slot and said sides defining at least one pin.

13. The push actuated latch of claim 12, said one wall defining a channel transverse to said entrance channel, and said lock including a stabilizer extending co-directionally with said pawl, said stabilizer being disposed in said channel transverse to said entrance channel.

* * * * *